US009365072B2

(12) United States Patent
Crowe et al.

(10) Patent No.: US 9,365,072 B2
(45) Date of Patent: Jun. 14, 2016

(54) PAINTING CANVAS PROTECTIVE DEVICE

(71) Applicants: Kathryn Linzee Crowe, Los Angeles, CA (US); Coleen Patrice Sterritt, Los Angeles, CA (US)

(72) Inventors: Kathryn Linzee Crowe, Los Angeles, CA (US); Coleen Patrice Sterritt, Los Angeles, CA (US)

( * ) Notice: Subject to any disclaimer, the term of this patent is extended or adjusted under 35 U.S.C. 154(b) by 15 days.

(21) Appl. No.: 14/306,475

(22) Filed: Jun. 17, 2014

(65) Prior Publication Data

US 2015/0360506 A1 Dec. 17, 2015

(51) Int. Cl.

| | |
|---|---|
| ***G09F 1/12*** | (2006.01) |
| ***B44D 7/00*** | (2006.01) |
| ***B44D 3/00*** | (2006.01) |
| ***A47G 1/10*** | (2006.01) |

(52) U.S. Cl.
CPC .. *B44D 7/00* (2013.01); *A47G 1/10* (2013.01); *B44D 3/00* (2013.01)

(58) Field of Classification Search
CPC ..... A47G 1/10
USPC ..... 40/783, 782, 784, 785, 797, 798, 799
See application file for complete search history.

(56) References Cited

U.S. PATENT DOCUMENTS

| | | | | | |
|---|---|---|---|---|---|
| 467,700 | A | | 1/1892 | Levy | |
| 836,010 | A | | 11/1906 | Brown | |
| 884,083 | A | * | 4/1908 | Faucette | 40/799 |
| 2,259,434 | A | * | 10/1941 | Blodgett | 40/783 |
| 2,815,600 | A | | 12/1957 | Caudle | |
| 2,866,286 | A | * | 12/1958 | Hartman | 40/741 |
| 2,976,985 | A | | 3/1961 | Kraus | |
| 3,289,343 | A | * | 12/1966 | Jensen | A47G 1/0633 40/783 |
| 3,451,153 | A | * | 6/1969 | Dohanyos | 40/741 |
| 4,122,617 | A | * | 10/1978 | Nielsen | A47G 1/0605 40/785 |
| 4,356,648 | A | * | 11/1982 | Beaulieu | A47G 1/0605 40/757 |
| 4,477,990 | A | * | 10/1984 | Buchanan | 40/784 |
| 4,606,140 | A | | 8/1986 | Mitchell | |
| 5,649,382 | A | * | 7/1997 | O'Keefe | G09F 1/12 40/785 |
| 5,692,333 | A | * | 12/1997 | McClave | A47G 1/10 40/785 |
| 7,770,315 | B2 | * | 8/2010 | Bauer et al. | 40/762 |
| 2010/0043268 | A1 | * | 2/2010 | Powell | A47G 1/10 40/741 |

FOREIGN PATENT DOCUMENTS

| | | | |
|---|---|---|---|
| FR | 2781422 | A1 | 1/2000 |
| JP | 2002103899 | A | 4/2002 |
| JP | 2004017646 | A | 1/2004 |

* cited by examiner

*Primary Examiner* — Shin Kim
(74) *Attorney, Agent, or Firm* — Fulwider Patton LLP

(57) ABSTRACT

Channel shaped corner devices for mounting to the corners of stretcher bars of an artwork frame and complementary channel shaped rails constructed to be connected between the corner devices by means of resilient snap on clips.

13 Claims, 3 Drawing Sheets

PAINTING CANVAS PROTECTIVE DEVICE

BACKGROUND

1. Field of the Invention

The present invention relates to devices for protecting framed artwork and the surface and perimetric edges of the frame.

2. Description of the Prior Art

Artwork such as paintings, drawings, photography and the like is often stretched over or around bars acting as rigid frames. The artwork may be unique and invaluable from either a financial or sentimental standpoint. It is oftentimes necessary to box the artwork for shipping, transportation or storage. All too frequently, the artwork is scratched or otherwise damaged when contacted by other frames or components with which it is shipped and sometimes damage is inflicted on the framework which itself can be very artistic and quite valuable.

In recognition of the need for protecting framed artwork and the like, many proposals have been made for protection of the frame and face of renderings and paintings. It has been proposed to provide wire clips which might clip over the corners of a picture frame to capture the respective corners of the rectangular frame for holding a covering material in position over the frame. A device of this type is shown in U.S. Pat. No. 467,700 to Levy. Devices of this type suffer the shortcoming that the adjacent objects may still be moved into close proximity and possibly contact and indent, scrape or otherwise damage the artwork itself.

Other efforts to provide protection for framed artwork have led to the proposal of wire clips formed for attachment to the backsides of the frames and to project over the edges of the frames themselves to form barriers at the front and sides of the frame seeking to protect the frame and purportedly allow a cloth or net covering to be stretched over the front of the artwork in hope of providing protection. A device of this type is shown in U.S. Pat. No. 8,363,010 to Brown. While providing some protection against dust and low impact contact, such devices fail to provide a sturdy, rigid barrier to positively prevent contact with the surface of the artwork around the corners and along all four sides of a frame.

Efforts have also been made to provide a somewhat sturdier device for attaching to a frame for spacing a covering from the front side of artwork and the frame. One such device includes a resilient visor device configured with a clamp like structure formed with a flange intended to fit against the inside wall from the back of the frame and to then flex and clip over the top of the frame to engage a lip with the front side of the frame to purportedly hold a curved visor in place t project forwardly of the lip. A device of this type is shown in U.S. Pat. No. 4,606,140.

Such devices, while beneficial for certain applications where frames are of a uniform dimension and depth, suffer the shortcoming that they are limited to only specific applications for certain frames, are not adaptable to different sizes of frames and can be readily dislodged by a jostling motion to which artwork might be exposed during movement, transportation and storage.

SUMMARY OF THE INVENTION

The apparatus of the present invention includes four orthogonal channel shaped corner devices having back walls for anchoring to the back wall of a picture frame or support and front walls spaced from the front of the frame, the corner devices being formed by legs projecting perpendicularly to terminate in ends which, when mounted on the frame are spaced apart a predetermined distance to confront one another. The apparatus further includes elongated channel shaped rails having a length of the selected distance to fit the between the confronting ends of the corner legs. Removable clips are provided for removable attaching the rails to the respective corner devices.

DETAILED DESCRIPTION OF THE PREFERRED EMBODIMENTS

Figure 7:
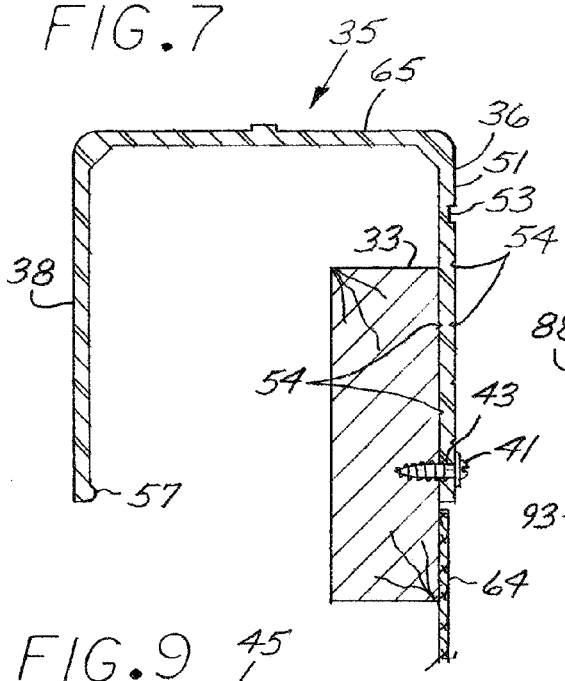
FIG. 7 is a transverse sectional view, in enlarged scale, taken along the line 7-7 of FIG. 6.

The artwork protector device of the present invention includes, generally, four orthogonal corner devices 21 of channel shaped construction configured with spaced apart front and back walls 23 and 25, respectively, defining U-shaped channel legs 24 and 26 terminating in respective ends 29 and 31 configured to be, when mounted on picture frame 33, spaced a predetermined distance apart. Received within the space defined by the predetermined distance are respective elongated rails 35 and 37, also of U-shaped channel construction to complement the cross sectional shape of the respective corner devices 21 and defining spaced apart front and back walls 36 and 38. The back walls of the respective corner devices and rails are secured to the back side of the picture frame 33 by means of fasteners 41 received in predrilled bores 43 (FIG. 7). The respective front walls 23 and 36 of the corner devices and rails, respectively, are spaced ¾ of an inch or so from the surface of the frame, depending on the depth of the frame, to act as barriers against objects coming into contact with the front of the frame and against the surface of the artwork 40.

Channel shaped, resilient clips, generally designated 45 (FIGS. 5 & 8), span the juncture between the legs of the corner devices 21. The cross section of the clips complement the shape of the legs and rails and serve to fasten the rails in position aligned with the respective legs of the corner devices 21 to thus hold respective front cowling walls 23 and 36 spaced in front of the respective picture frame 31 (FIGS. 7-9) to block contact with the artwork 40 rendered on backing 41 carried in such frames.

Paintings, photographs, and other artwork often have substantial intrinsic and material value, oftentimes unique to the piece of work without any true replacement value. Damage to such artwork can be devastating for the owner or custodian of the artwork itself and destroy relationships and the value of an estate or collection.

Merely covering the face of the artwork itself with a cloth or the like may damage the work itself and certainly fails to protect the periphery of the frame encasing the artwork. Even bubble wrap or the like only provides a cushioning effect which, if contacted by the sharp corners or hard surfaces or adjacent objects can puncture and penetrate to the artwork itself, thus destroying the value. It is this concern to which the present invention is directed.

In one preferred embodiment of the present invention the corner pieces 25 and rails 35 and 37 are constructed of extruded ABS plastic, having sufficient rigidity so that the cowlings will be separated spaced in front of the frame 33 prevent contact by adjacent objects.

The wooden, plastic or metal frames of artwork may vary in dimension, both in plan view and in thicknesses. A frame may be about ¾ of an inch thick and may vary in width from ½ to several inches and in plan view may be, for instance, a foot to several feet on a side. To accommodate these variations in dimensions, in one preferred embodiment, we fabricate the corner devices of extruded ABS plastic formed with a channel shape to provide front and back walls 23 and 25 spaced about $\frac{1}{8}^{th}$ inches thick and spaced apart about 3¼ inches measured to the outside. In this particular embodiment, we constructed the front and back walls 23 and 25 with a transverse length of about $3\frac{1}{8}^{th}$ inches to provide ample length for spanning a portion of the backside of the frame 33 and to cause the front cowling wall 23 to act as a cowling wall to provide some substantial degree of protection against direct contact with the frame or the artwork.

Figure 3:
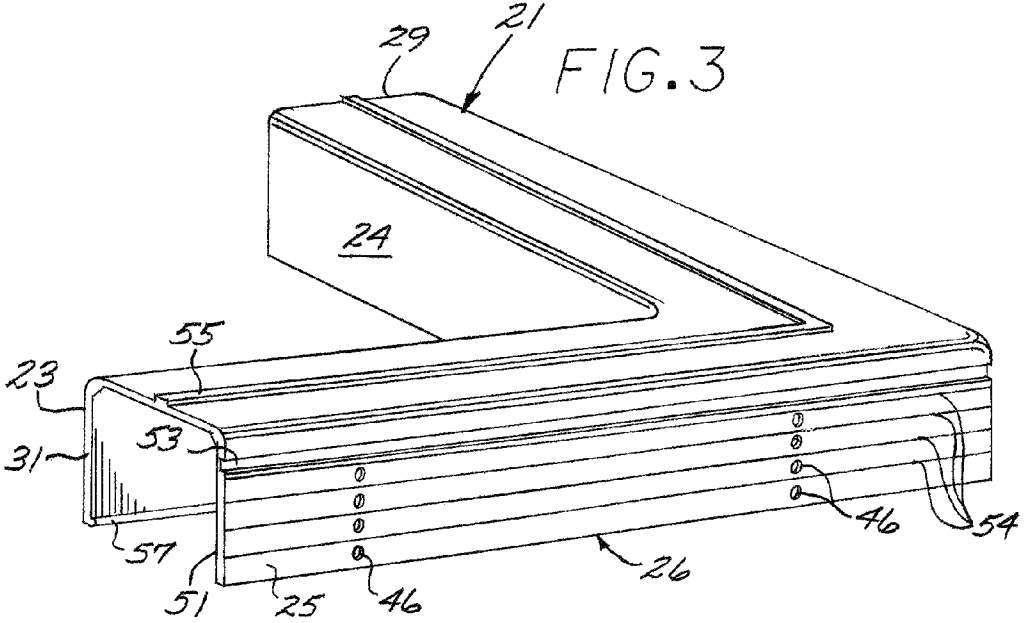
FIG. 3 is a perspective view of a corner device incorporated in the present invention.

In the exemplary embodiment, we construct the corner devices 21 with the channel shaped orthogonal legs having an overall length of about 6-9 inches. We configured the back wall 51 with a fastener groove 53 (FIG. 3) extending longitudinally therealong. The return wall 26 is formed with an upstanding, longitudinal registration rib 55 (FIG. 8) and the front wall 23 is formed on its free extremity with an in-turned latching lip 57 to facilitate connection with the clip 45.

The back wall 25 is formed on its backside with a plurality of longitudinally projecting, parallel V-shaped index grooves 54 acting as indicia to form markers to define respective indexes for indexing the orientation of the devices on the frame 33.

Formed in spaced relation along the marginal edge of the back walls 25 are respective predrilled bores 46 for receipt of the screws 41.

Figure 1:
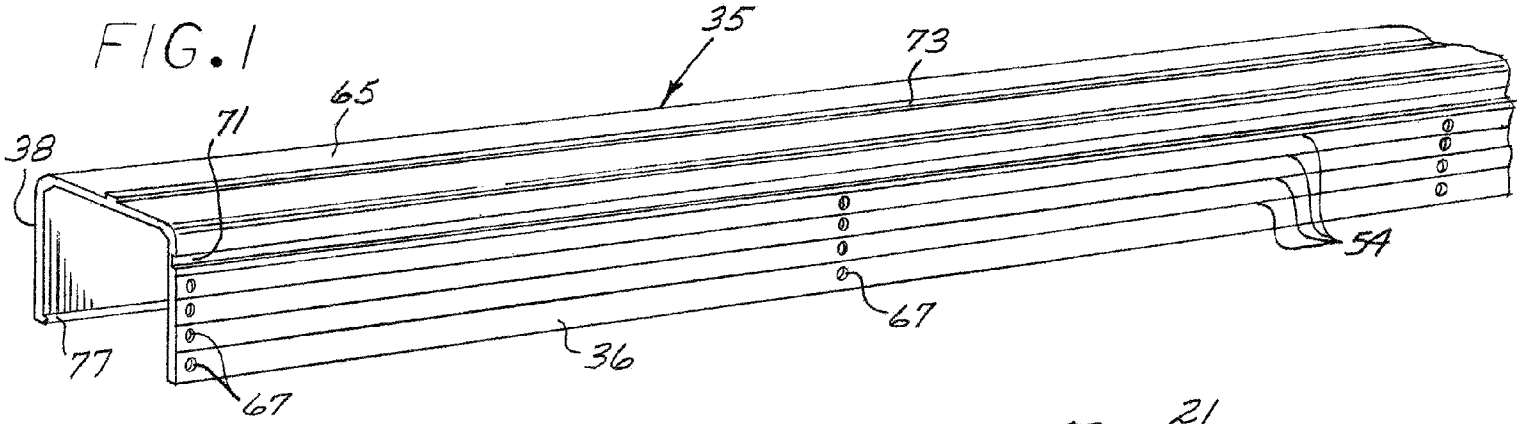
FIG. 1 is a perspective view of a channel rail incorporated in the present invention.

As mentioned above, the rails 35 are channel shaped to complement the cross sectional shape of the respective legs of the corner devices 21. The rails are thus formed with the back walls 38 and front or cowling walls 36 connected by a return wall 65. The back walls include predrilled holes 67 spaced along the length thereof. The back walls 36 further include respective fastener grooves 71 to align with the fastener grooves 53 in the corner devices. The return wall 65 includes raised, longitudinal reinforcing index rib 73 aligned with the rib 55 of the corner devices. The elongated cowling wall 38 is formed at its free end with an in-turned latch lip 77 (FIG. 1). The rails 35 are cut to length to fit between the spaced apart legs of the corner devices 21.

The clips 45 are about three inches long and are also constructed of extruded ABS and are likewise channel shaped in transverse cross section to complementally fit over joints between the terminal ends of the respective legs of the corner devices and the abutting ends of the rails 35 and are resilient to snap into place.

Figure 2:
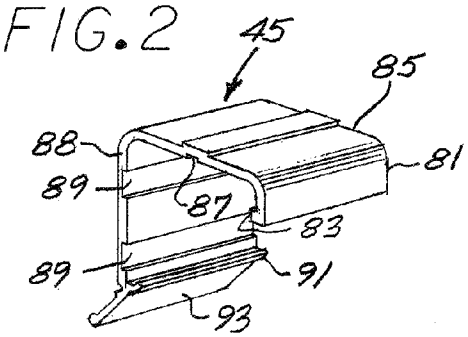
FIG. 2 is a perspective view of a clip incorporated in the present invention.
Figure 4:
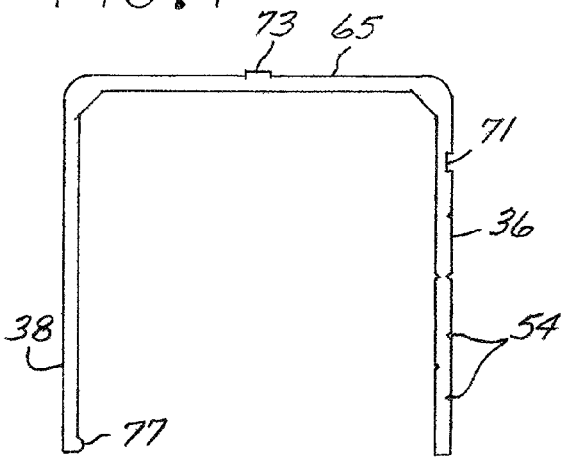
FIG. 4 is a left end view, in enlarged scale, of the rail shown in FIG. 1.
Figure 5:
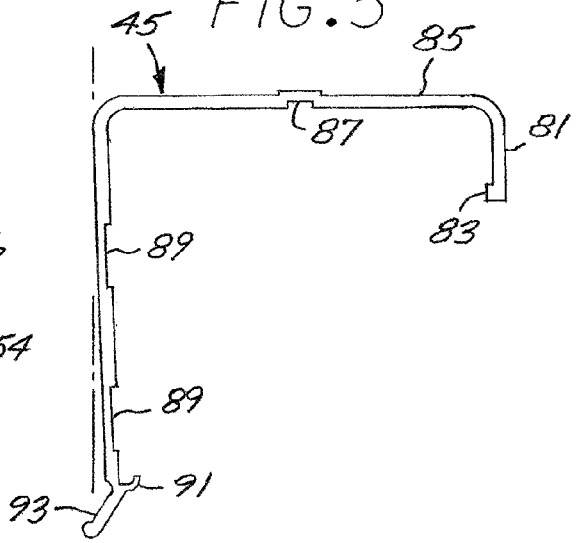
FIG. 5 is a left hand end view, in enlarged scale, of the clip shown in FIG. 2.
Figure 6:
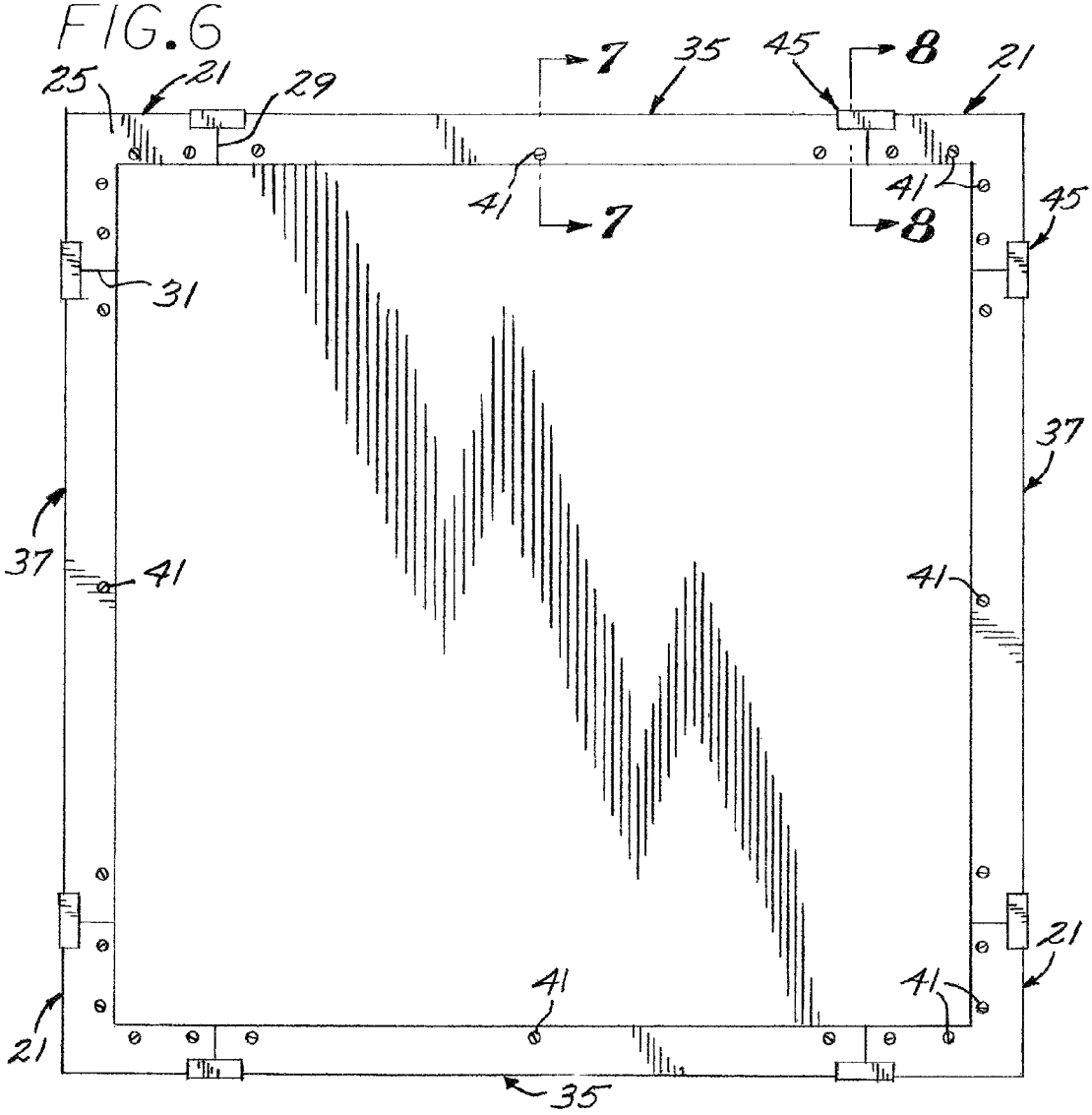
FIG. 6 is a back plan view of a frame on which the apparatus of the present invention is mounted, in reduced scale.
Figure 8:
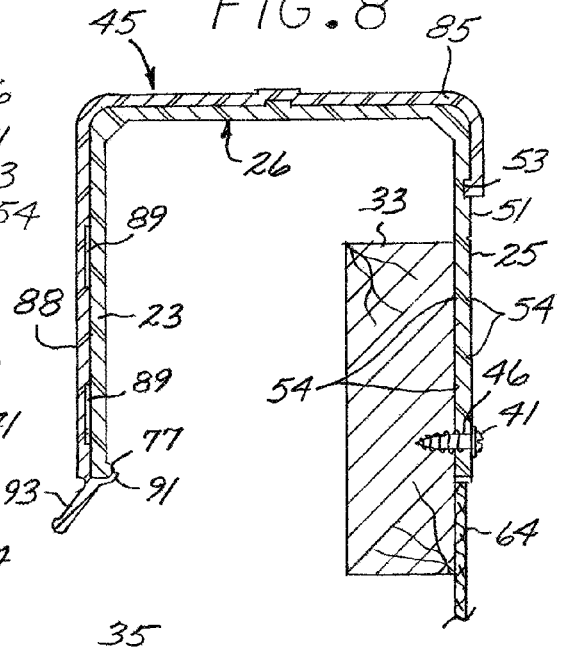
FIG. 8 is a transverse sectional view, in enlarged scale, taken along the line 8-8 of FIG. 6.
Figure 9:
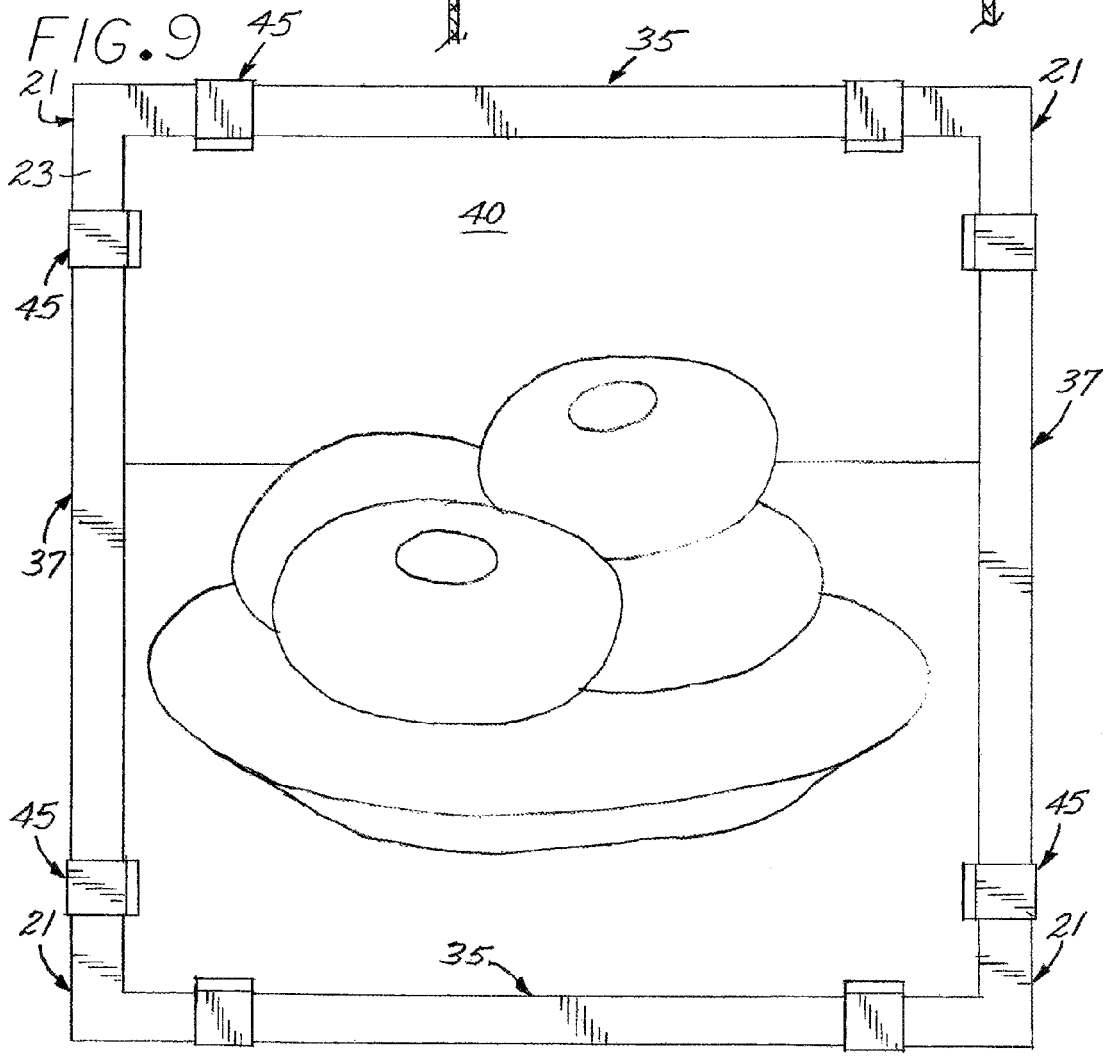
FIG. 9 is a front plan view of the frame and invention shown in FIG. 6.

Referring to FIGS. 2, 5, and 8, the clips 45 are formed with respective stub back walls 81 configured at their free, lateral extremities with respective longitudinal, in-turned fastener latches 83 formed to be complementally received in the respective latch grooves 51 and 71. As mentioned, the clips are channel shaped with the return wall 85 of each formed on its interior with a central, inwardly opening, longitudinal groove 87 to be complementally received over the abutting extremities respective indexing ribs 55 and 65.

The front walls 88 of the respective clips are formed along the interiors with respective relief grooves 89. The walls 88 are formed at their free extremities with respective inwardly directed hooks 91 configured to hook over the respective latching lips 57 and 77. Finger grasp tabs 93 project diagonally outwardly from the respective hooks 91 (FIGS. 5 and 8).

In operation, it will be appreciated by those skilled in the art that the stretcher bars forming frames 33 on which artwork is stretched can come in many different sizes and configurations but is typically rectangular in shape defining orthogonal corners. Our invention takes advantage of this fact by packaging sets of corner devices and rails in a retail package which may include eight corner devices 21 and 4, rails 31 of selected lengths such as, for instance, 2, 3, or 4 feet in length. As will be appreciated, the rails can be cut to match the size of the particular frame. Also included in the package are four clips 45 and 20 and washerhead screws 43 to be received in the predrilled holes of the corner devices and rails for anchoring the apparatus in position.

The user will thus position the corner devices 21 on the corners of the stretcher bars defining the frame and align a selected one of the parallel incised index grooves 54 spaced from the outside edges of the respective bars defining the frame 33 to facilitate positioning and orientation of the respective corner devices with the desired standoff distally from the outside edges of the frame (FIGS. 7 and 8). Once aligned at the desired standoff position, the user may drill small pilot bores in the frame through the predrilled holes 46 or, for softer woods, may merely insert the washer head screws 43 to securely fasten the respective corner devices 21 to the corners of the frame 33.

For many standard configurations of stretcher bars, the 6-9 inch runs of the legs for corner devices 21 will provide a spacing between the ends of such legs to provide a space of 2, 3, or 4 feet for receipt of rails 35 of that length. The selected rails may thus be moved into position with the respective back walls 61 positioned behind the frame 33 as at FIG. 7. It will be appreciated that in making this positioning, the rails 35 and 37 may be merely aligned with the ends of the respective legs of the corner devices 21, it also being appreciated that the incised index groves 54 can facilitate this positioning.

Once the rails 35 have been positioned between the ends of the legs of the corner devices 21, the clips 45 may be aligned over the seams or joints between the ends 29 of the corner devices 21 and the respective clips moved into position with the respective flanges 83 engaged with the respective adjacent extremities of the grooves 53 and 71 so the clips may be fitted over the marginal ends of the rails and legs of the corner devices with the proximate extremities of the respective index ribs 55 and 73 received in the respective grooves 87. The front walls of such clips will thus juxtapose the cowling walls 53 to allow the respective hooks 91 to be snapped into position underneath and about the respective latching lips 57 and 77 to maintain the rails in alignment with the corner devices. As will be appreciated by those skilled in the art, for artwork stretcher bars having longer lengths, two or more rails 35 may be installed in alignment with one another and additional clips 45 purchased for fastening of those rails to the respective corner devices. With the rails held in place by the respective clips 45, the washer screws 43 may be inserted through selected ones of the bores 67, with or without pilot bores in the stretcher bar frame to securely anchor the respective rails in position to positively hold the respective back anchor walls 36 in place.

With the apparatus of the present invention installed in place, it will be appreciated that the respective cowling walls 23 and 51 of the corner devices and rails 34, being stood off from the front of the frame and extended plane of the artwork, provide protection for the distal edges of the stretcher bars defining the frame 33 so that positive protection is provided for the frame 33 and the stretched artwork 40.

The artwork may then be conveniently transported or stored with the owner being secure that the artwork is protected from direct engagement by adjacent furniture, artwork, frames or the like to thus positively avoid damage to the artwork itself. When the destination is reached or the artwork retrieved from storage, the apparatus may be removed from the frame by backing out the fastener screws and the corner devices and rails stored for use in the future when other artwork is to be stored or shipped.

From the foregoing it will be appreciated that the present invention provides an ideal protective device for two dimensional artworks which is convenient to install and is relatively inexpensive to manufacture. The installation can easily be made by one person aligning the corner devices utilizing the incised index lines to facilitate spacing thereof about the periphery of the frame and convenient alignment of the rails with the respective corner devices for installation of the fastener clips and the fastener screws. The device is relatively fool proof for isolating artwork for shipping and allows for multiple pieces of artwork to be fitted in a shipping crate without concern for damage from direct contact. The device is adaptable for mounting on artwork frames of different sizes and, upon removal, can be stored and re-used at a later date. The apparatus provides such positive protection that the artwork might be shipped in moving trucks or the like without the necessity of crating or wrapping in protective wraps. If desirable, the artwork may still be wrapped and the device of the present invention will protect the wrapping from direct contact with the artwork itself.

Although the present invention has been described in detail with regard to the preferred embodiments and drawings thereof, it should be apparent to those of ordinary skill in the art that various adaptations and modifications of the present invention may be accomplished without departing from the spirit and the scope of the invention. Accordingly, it is to be understood that the detailed description and the accompanying drawings as set forth hereinabove are not intended to limit the breadth of the present invention.

We claim:

1. Apparatus for protecting artwork mounted in a rectangular frame having corners, back and front sides and comprising:

corner devices for mounting to the corners and including elongated orthogonal channel shaped legs terminating in leg ends to be, when the corner devices are mounted to adjacent ones of the corners, spaced selected distances from one another and formed with respective corner device back walls to mount to the back side of the frame and return walls wrapping over the periphery of the frame to project forwardly beyond the front side and formed with respective cowling walls to be spaced from the front side, the back walls formed with rearwardly opening longitudinal locking grooves;

elongated channel shaped rails constructed to complement the shape of the channel shaped legs and of respective lengths to correspond with the selected distances to fit between the respective leg ends and cooperate with the respective leg ends to form joints, the rails including back walls to align with the corner device back walls and formed with rearwardly opening, longitudinal rail locking grooves to align with the elongated locking l grooves; and resilient, channel shaped clip devices to be clipped over the respective joints to hold the respective rails to the respective legs, the clip devices including respective one extremities formed with respective elongated latch flanges to be received in the respective locking grooves and second extremities formed with respective latches to hook onto the corner devices and rails.

2. The apparatus of claim 1 wherein:

the cowling walls are formed with edges defining in-turned lips; and the clips are formed with respective latch hooks to removably clip over the respective lips.

3. The apparatus of claim 1 wherein:

the respective corner devices are configured with orthogonal channel shaped legs substantially 6 inches long.

4. The apparatus of claim 1 wherein:

the clips are constructed with respective lengths of substantially three inches.

5. The apparatus of claim 1 wherein:

the corner devices and rails, when mounted to the frame, cooperate to form a continuous barrier about the periphery of the frame.

6. The apparatus of claim 1 wherein:

the corner devices are configured with the back walls formed with predrilled holes spaced longitudinally there-along.

7. The apparatus of claim 1 wherein:

the rails include back walls formed with predrilled fastener holes spaced longitudinally there-along.

8. The apparatus of claim 1 wherein:

the rails and corner devices are formed with incised parallel lines to be, when installed, aligned with one another.

9. The apparatus of claim 1 wherein:

the corner devices are made of ABS plastic.

10. The apparatus of claim 1 wherein:

the rails are made of ABS plastic.

11. The apparatus of claim 1 that includes:

mechanical fasteners for fastening the apparatus to the back side of the frame.

12. The apparatus of claim 1 wherein:

the fasteners are threaded screws.

13. Apparatus for protecting artwork mounted in a rectangular frame having corners and front and back sides and comprising:

corner mount devices constructed of ABS plastic and configured with elongated channel shaped orthogonal legs terminating in leg ends and having respective front and back walls connected by a return wall, the return walls being formed with respective longitudinal extending, transversely projecting mount registration ribs, the respective back walls being configured with outwardly facing longitudinally projecting locking grooves, and also being formed with longitudinally projecting, laterally spaced apart indexing indicia and even further formed with longitudinally spaced apart predrilled mounting bores, the front wall being configured at its free extremity with an in-turned latching lip;

a plurality of rails constructed of ABS plastic formed with a transverse cross sectional shapes corresponding with the predetermined cross sectional shape, formed with front and back walls spaced laterally apart, connected by respective return walls and configured to be, when the corner mount devices are mounted on adjacent corners of the frame, received between the respective leg ends of the adjacent corner devices, the return walls including respective longitudinal, transversely projecting rail registration ribs to be aligned with the mount registration ribs, the back walls being formed with respective rearwardly opening locking grooves and further including mounting bores spaced longitudinally therealong and even further including back surfaces formed with longitudinal, parallel, transversely spaced apart indexing indicia, the front walls projecting laterally to be formed with respective with free extremities defining latching lips; and a plurality of channel shaped clips substantially 3 inches long and constructed to be received complementally over the juncture between the opposite ends of the respective rails and the respective leg ends and including a return wall configured with an interior surface formed with respective registration grooves to complementally fit over the respective mounts and rail registration ribs, a rear stub wall formed with respective in-turned locking flanges to be received in the respective locking grooves, the clips further formed with respective front walls configured at their free extremities with respective latching hooks to selectively latch over the latching lips of the respective legs and rails, the clips further including projecting finger grasp tabs adjacent the respective latching flanges.

* * * * *